US006231757B1

(12) United States Patent
Huber

(10) Patent No.: US 6,231,757 B1
(45) Date of Patent: May 15, 2001

(54) APPARATUS FOR COLLECTING AND REMOVING SOLID PARTICLES FROM A FLOWING FLUID

(75) Inventor: Hans Georg Huber, Berching (DE)

(73) Assignee: Hans Huber GmbH Maschinen-Und Anlagenbau, Berching (DE)

( * ) Notice: Subject to any disclaimer, the term of this patent is extended or adjusted under 35 U.S.C. 154(b) by 0 days.

(21) Appl. No.: 09/471,063

(22) Filed: Dec. 22, 1999

(30) Foreign Application Priority Data

Jan. 12, 1999 (DE) ..... 199 00 817

(51) Int. Cl.[7] ..... B01D 29/70; B01D 33/52; E02B 5/08

(52) U.S. Cl. ..... 210/155; 210/158

(58) Field of Search ..... 210/155, 158, 210/162, 154, 359, 357

(56) References Cited

U.S. PATENT DOCUMENTS

| | | | | |
|---|---|---|---|---|
| 1,773,576 | | 8/1930 | Downes . | |
| 4,853,116 | * | 8/1989 | Wallander | 210/155 |
| 5,032,262 | * | 7/1991 | Wallander | 210/155 |
| 5,456,826 | * | 10/1995 | Mellegard | 210/155 |
| 5,770,055 | * | 6/1998 | Wallander et al. | 210/155 |

FOREIGN PATENT DOCUMENTS

| | | |
|---|---|---|
| 40 01 859 C 2 | 8/1996 | (DE) . |
| 197 14 089 A 1 | 10/1998 | (DE) . |
| 0 221 991 B1 | 5/1987 | (EP) . |
| 0 682 551 B1 | 11/1995 | (EP) . |
| WO 91/14048 | 9/1991 | (WO) . |

* cited by examiner

*Primary Examiner*—Robert Popovics
(74) *Attorney, Agent, or Firm*—Thomas, Kayden, Horstemeyer & Risley, LLP

(57) ABSTRACT

An apparatus for collecting and removing solid particles from a flowing fluid (5) includes a grid unit (6) including a plurality of stationary bars (1) being arranged to form a stationary bar unit (3), each of the stationary bars (1) including a plurality of steps (8) and including a skeleton portion (9) and a rising portion (10). A plurality of movable bars (2) is arranged to form a movable bar unit (4), each of the movable bars (2) including a plurality of steps (8) and including a skeleton portion (9) and a rising portion (10). The stationary bars (1) and the movable bars (2) are arranged side by side to alternate. The steps (8) include an undercut (11, 13). A drive (25) moves the movable bar unit (3) along a closed path of movement (21) being substantially elliptical. The path of movement (21) includes a forward movement, an upward movement and a backward movement The path of movement (21) is coordinated with the shape of the steps (8) of the bars (1, 2) such that the skeleton portion (9) of the movable bars (2) is covered by the skeleton portion (9) of the stationary bars (1) during the forward movement and it is not covered thereby during the backward movement. The skeleton portion (9) of the movable bars (2) is covered by the rising portion (10) of the stationary bars (1) during the downward movement and it is not covered thereby during the upward movement.

23 Claims, 8 Drawing Sheets

APPARATUS FOR COLLECTING AND REMOVING SOLID PARTICLES FROM A FLOWING FLUID

CROSS REFERENCE TO RELATED APPLICATIONS

This application claims the benefit of co-pending German Patent Application No. 199 00 817.5 entitled "Vorrichtung zum Abscheiden und Herausfördem von Abscheidegut aus einer strömenden Flüssigkeit, insbesondere Abwasser", filed on Jan. 12, 1999.

FIELD OF THE INVENTION

The present invention generally relates to an apparatus for collecting and removing solid particles from a flowing fluid, especially from waste water. Such an apparatus is also called a separating grid or a step screen. The apparatus includes a stationary bar unit and a movable bar unit. More particularly, the present invention relates to an apparatus for collecting and removing solid particles from a flowing fluid in which the steps of the bar units include an undercut.

BACKGROUND OF THE INVENTION

Apparatuses for collecting and removing solid particles from a flowing fluid are commonly known. They are used in sewage treatment plants in which domestic or industrial sewage is cleaned. They are also used to clean washing water or process water or to screen mud or the like.

An apparatus for collecting and removing solid particles from a flowing fluid is known from European Patent No. EP 0 221 991 B1. The apparatus includes a first set of stationary bars and a second set of movable bars. The stationary bars and the movable bars are alternately arranged, and they include steps at their side facing the flowing fluid. The steps include a substantially horizontal skeleton portion and a substantially vertical rising portion in a way that the steps form a rectangular stepped curve. The movable bars are interconnected to form a movable bar unit being driven along a closed circuit with respect to the stationary bars. The movable bar unit is driven by two eccentric discs in a forced manner. The upwardly directed component of movement of the circuit is slightly greater than the height of the steps of the stationary bars. The movable bars form a unit with side walls. The side walls also serve to transmit the circular movement to the movable bars. The bars including the rectangular steps are arranged such that they are declined. In other words, the apparatus is arranged in the fluid at a small inclination angle. This means that the apparatus has a comparatively great length in the flowing direction of the fluid. FIG. 6 of the European Patent No. EP 0 221 991 B1 illustrates a more steep arrangement of the bars. The bars include undercuts being arranged in the skeleton portion and in the rising portion. Thus, the steps include corners or tips protruding in a forward and in an upward direction. Again, the movable bar unit is guided along a circular path. The upwardly directed component of movement is a little bit greater than the height of the steps of the bars. The diameter of the circuit is substantially greater than the distance between two adjacent corners of the steps. The solid particles to be removed from the fluid tend to be squeezed, pushed or dislocated in an undesired way when they are transported. Not all solid particles are deposited on the next upper step as desired.

Another similar separating grid is known from the European Patent No. EP 0 682 551 B1. The separating grid includes a stationary bar unit and a movable bar unit. A driving mechanism is arranged above the flowing fluid to move the movable bar unit along a closed and substantially circular path of movement. The movement includes a vertical component of movement the value of which is greater than the height of the steps of the bars. The steps of the bars do not include any undercuts, but their surfaces form an angle being a little bit above 90 degrees. Some of the steps are arranged to be declined in a downward direction. The drive for the movable bar unit is designed and arranged such that the movable bar unit in its upper region is exactly guided on a circular path. The circular movement is provided by an eccentric device. The drive also includes a pulling element with a connecting mechanism providing a path of movement being similar to a circuit. In this way, the movable bar unit at each point is differently moved about the height of the bars. The path of movement is closed, and it is very similar to a circuit. The circuit includes a vertical component of movement being more than the height of the steps of the bars. With this arrangement, the solid particles are not transported in an upward direction in a way as desired. The upward movement of the particles is disturbed by pushing effects.

A step screen is known from German Patent Application No. DE 197 14 089 A1. The step screen includes a stationary first bar unit including stationary spaced apart bars and a movable second bar unit including movable bars. All bars include a majority of steps at their surface facing the flowing fluid. The steps include a horizontal skeleton portion and a vertical rising portion. The steps do not include any undercuts. The second bar unit is driven along a closed path of movement in the plane of main extension of the bars. The upwardly directed component of movement of the path of movement is slightly greater than the vertical height of the steps of the bars. The drive includes two separately controllable actuating drives driving the movable bar unit in two different actuating directions. In this way, the adjustment of the movable bar unit is more variable. The path of movement surrounds a surface, and it is divided into substantially linear sections of the movement, the sections preferably being vertical and linear. The actuating drives are arranged to be vertical and horizontal. Consequently, the circular movement known from the above described prior art is replaced by a rectangular movement. The separating grid has a relatively great length corresponding to the sum of the widths of the skeleton portions.

Such apparatuses known in the prior art require undercuts being provided at the bars to convey bigger solid particles, as for example cans. These undercuts being especially arranged in the rising portion of the steps result in an enlargement of the bars to attain the necessary stability of the bar unit. Additionally, undercuts require an enlargement of the radius of the circular path of movement along which the movable bar unit is guided. As a result, the solid particles to be collected and conveyed out of the flowing waste water are squeezed and crushed.

SUMMARY OF THE INVENTION

Briefly described, the present invention provides an apparatus for collecting and removing solid particles from a flowing fluid. The apparatus includes a grid unit including a plurality of stationary first bars being arranged to form a first bar unit, each of the stationary first bars including a plurality of steps facing the flowing direction of the fluid and including a skeleton portion and a rising portion. A plurality of movable second bars is arranged to form a movable second bar unit, each of the movable second bars including a plurality of steps facing the flowing direction of the fluid and including a skeleton portion and a rising portion. The stationary first bars and the movable second bars being arranged side by side or parallel to alternate. The steps include an undercut. A drive moves the movable second bar unit along a closed path of movement being substantially elliptical. The path of movement includes a forward movement being directed substantially against the flowing direction of the fluid, an upward movement, a backward movement being directed substantially in the flowing direction of the fluid and a downward movement. The path of movement is coordinated with the shape of the steps of the first and second bars such that the skeleton portion of the movable second bars is covered by the skeleton portion of the stationary first bars during the forward movement, the skeleton portion of the movable second bars is not covered by the rising portion of the stationary first bars during the upward movement, the skeleton portion of the movable second bars is not covered by the skeleton portion of the stationary first bars during the backward movement, and the skeleton portion of the movable second bars is covered by the rising portion of the stationary first bars during the downward movement. For example, the skeleton portion of the movable second bars being "covered" by the skeleton portion of the stationary first bars during the forward movement means that the stationary bars overlap the movable bars in the projection. In other words, the skeleton portion of the movable second bars is located below the skeleton portion of the stationary first bars during the forward movement. Similar is true for the other directions of movement of the movable bar unit with respect to the stationary bar unit. In this way, the particles, items or articles to be collected and removed from the fluid are correctly transported from a first step to the next step in an upward direction.

The present invention is based on the concept to better coordinate the shape of the steps of the bars with the shape of the path of movement along which the movable bar unit is moved. The closed path of movement is predetermined by the shape of the steps. A parallelogram-like field results from a parallel displacement of the shape of the skeleton portion and of the rising portion of the step. This field may not be entered by the path of movement of the movable bar unit. The path of movement is parallelogram-like or similar to the shape of an ellipse. It is possible that the path of movement exactly follows the shape of an ellipse. It is also possible that the path of movement only looks similar to an ellipse. Generally, the distance between the actual path of movement and the theoretical outline of the field is not critical. Nevertheless, this distance preferably has a small value to reduce the expenditure for the realization of the drive. In the projection, the actual path of movement and the theoretical outline of the field should not contact, overlap, cover or interpenetrate each other. On the other hand, it is desirable to realize the path of movement by a drive in a simple fashion. The drive has to be designed and arranged with respect to the shape of the steps such that the elliptical path of movement or the path of movement being similar to an ellipse with its bigger semiaxis being located to be inclined. In this way, the structural length of the apparatus is decreased. The apparatus may be arranged in a comparatively steep way and the solid particles to be transported are removed from the flowing fluid without being squeezed, cut or dropped.

The path or track of movement of the drive for the movable second bar unit at the end of the substantially horizontal forward movement preferably is guided through the edges or the tips of the steps of the stationary bars. In this way, not only the dimensions of the smaller semiaxis of the path of movement is reduced, but the entire length of the skeleton portion is covered in the reception point of the solid particles. The solid particles are not pushed together at the skeleton portion of the step.

The path of movement of the drive for the movable second bar unit preferably is guided through the corners or tips of the steps of the stationary bars during the substantially horizontal backward movement. In this way, not only the smaller semiaxis of the elliptical path of movement is reduced, but the entire length of the skeleton portion in the reception point of the solid particles is covered. The solid particles are not ejected by the rising portion of the step.

The path of movement of the drive for the second bar unit may be guided through all four corners of a field being formed by a parallel displacement of the skeleton portion and the rising portion of the step. This design has the advantage of the path of movement being especially compact without departing from the solid particles being correctly conveyed. Consequently, the expenditure for the drive is reduced. At the same time, the solid particles to be removed from the fluid are not pushed together when they are located on the skeleton portion. This means that the solid particles are conveyed from a first skeleton portion in an upward direction to a second skeleton portion without additional undesired dislocation.

There is a number of possibilities of realizing the drive for the movable bar unit. For example, the drive for driving the movable second bar unit in the closed path of movement may include a curved path. The curved path or the curved track approximately has an elliptical shape. The curved path may include ellipse-like stationary cam plates. A joint is moved along the curved path. This movement of the joint is transferred to the movable bar unit. Usually, the drive includes two portions to move the movable bar unit in the upper portion as well as in its lower portion uniformly and parallel to itself. It is not necessary that the two paths of movement in the upper portion and in the lower portion are identical.

It is also possible that the drive for the movable second bar unit includes a connecting rod drive. Such a connecting rod drive includes a plurality of pivotally interconnected rods partially being supported by stationary bearings. With this arrangement, the elliptical or ellipse-like path of movement is transferred onto the movable bar unit.

The drive may also include two hydraulically or pneumatically actuated cylinders. The cylinders with their axis may be arranged at an angle. The cylinders may have the same active length to provide the elliptical or ellipse-like path of movement. The two hydraulic or pneumatic cylinders are coordinated with each other, and they are actuated at the same time such that the elliptical path of movement or the path of movement being similar to an ellipse is attained.

The skeleton portion and the path of movement are preferably arranged to be upwardly inclined against the flowing direction of the fluid. Such an arrangement is especially desirable in case the undercuts of the steps are exclusively arranged in the region of the skeleton portion. With this arrangement, it is possible to convey bigger items, for example cans, in an upward direction without the danger of such items falling down the steps and not successfully being removed from the flowing fluid. The movable second bar unit is guided parallel along the closed path of movement by the drive. Consequently, the movable second bar unit is moved parallel to itself, and the same path of movement is attained at each step, so that the solid particles are not squeezed or dislocated on the skeleton portions.

Other objects, features and advantages of the present invention will become apparent to one with skill in the art upon examination of the following drawings and the detailed description. It is intended that all such additional objects, features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
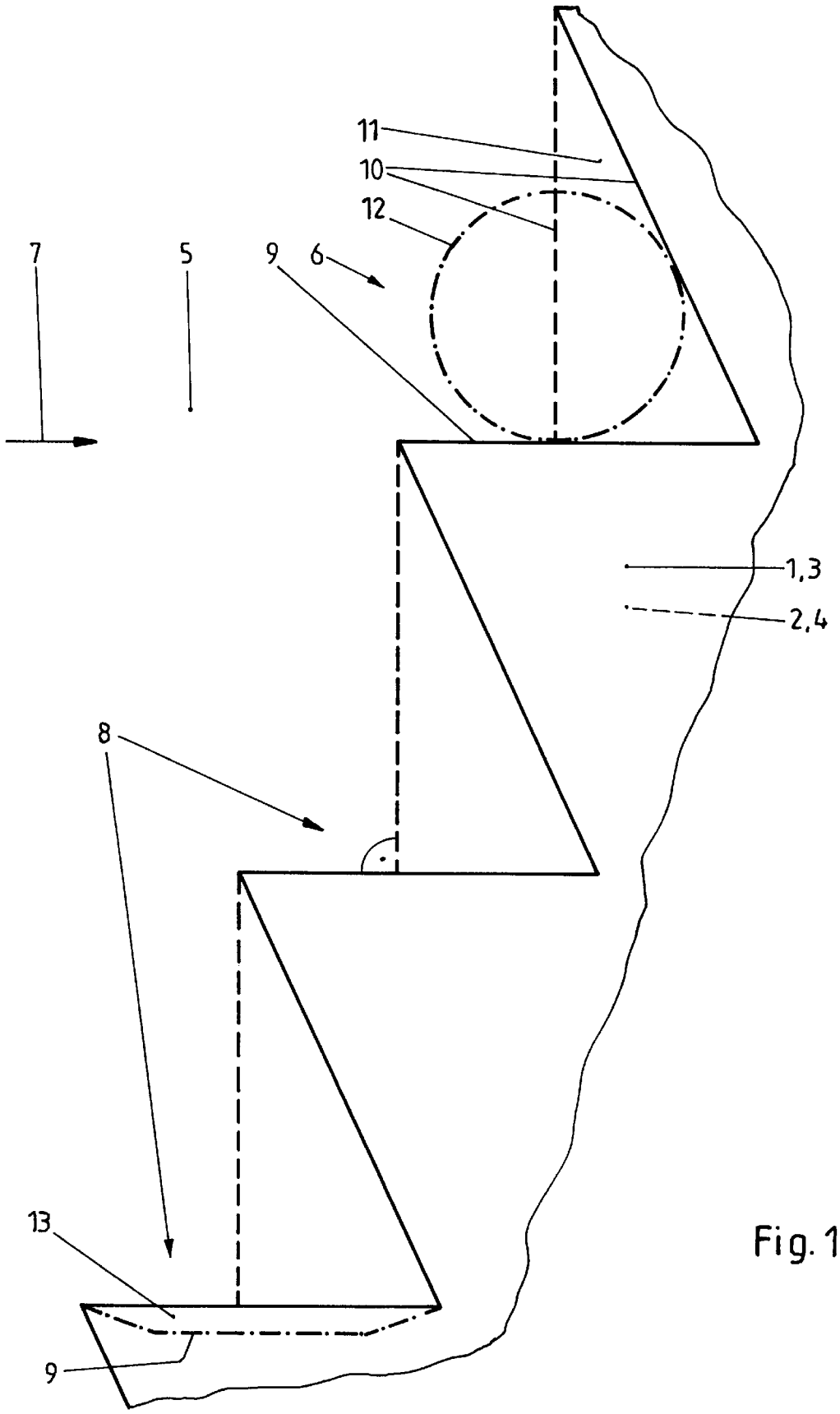
FIG. 1 is a side view of a movable bar having undercuts in the region of the skeleton portion of the steps.

Referring now in greater detail to the drawings, FIG. 1 illustrates a side view of a stationary bar 1. Separating grids for collecting and removing solid particles and items from a flowing fluid include a plurality of such stationary bars 1 being arranged in a spaced apart manner with respect to one another in a direction perpendicular to the plane of illustration of FIG. 1. Thus, FIG. 1 only illustrates one stationary bar 1. The other stationary bars 1 are arranged such that their outlines are covered by the illustrated bar 1. A movable bar 2 is arranged between two stationary bars 1 in the direction perpendicular to the plane of illustration. The outline of the movable bars 2 is also covered by the outline of the illustrated stationary bar 1 in the starting position as illustrated in FIG. 1. The stationary bars 1 are designed and arranged to form a stationary first bar unit 3. The movable bars 2 are designed and arranged to form a movable second bar unit 4. When the separating grid is driven, the movable second bar unit 4 including the movable bars 2 is moved parallel to its plane of main extension, i.e. in parallel planes to the plane of illustration of FIG. 1. The two bar units 3 and 4 are part of a grid unit 6 contacting the fluid 5. The grid unit 6 is arranged to be inclined in the flowing direction 7 of the fluid 5 relative to the grid unit 6 as indicated by an arrow.

The bars 1 and 2 include steps 8 being arranged at their side facing the fluid 5 according to the flowing direction 7. Each step 8 includes a skeleton portion 9 and a rising portion 10. In the illustrated embodiment of FIG. 1, the skeleton portion 9 is arranged to be horizontal. Nevertheless, it is also possible to arrange the skeleton portion 9 at a different angle with respect to the flowing direction 7 of the fluid 5. The skeleton portion 9 may be inclined to increase against the flowing direction 7 of the fluid 5. The part of the step 8 being substantially horizontal is designated by the skeleton portion 9. The part of the step 8 being substantially vertical is designated by the rising portion 10. The rising portion 10 may be arranged to be vertical, as indicated by the broken line in FIG. 1. Nevertheless, the rising portion 10 may be also arranged to be inclined, as it is illustrated by the continuous line in FIG. 1. It is also possible that the step 8 has a curved or bent shape in the region of the rising portion 10. The rising portion 10 being illustrated by the broken line is arranged at 90 degrees with respect to the skeleton portion 9. Such an arrangement would occur if the steps 8 were designed and arranged in a rectangular shape. Such a design of the steps 8 would not include any undercuts. The present invention does not relate to such a rectangular design of the steps 8 without undercuts.

In case the rising portion 10 is arranged to be inclined, as illustrated by the continuous line in FIG. 1, the step 8 includes an undercut 11 with respect to the rising portion 10 being illustrated by the broken line. Such an undercut 11 makes sense to, for example, transport bigger items from a first step 8 in an upward direction to a second step 8. To render this clear, a can 12 is illustrated by a broken line.

It is also possible that the skeleton portion 9 includes an undercut 13, as it is illustrated in the lowermost step 8 of FIG. 1 by a dash-dot line. The skeleton portion 9 has a bent, curved or otherwise hollow design. The present invention relates to steps 8 of the bars 1 and 2 including at least one of the two undercuts 11 or 13. It is understood that the design of the steps 8 may be also chosen to include both undercuts 11 and 13 at the same time.

Figure 2:
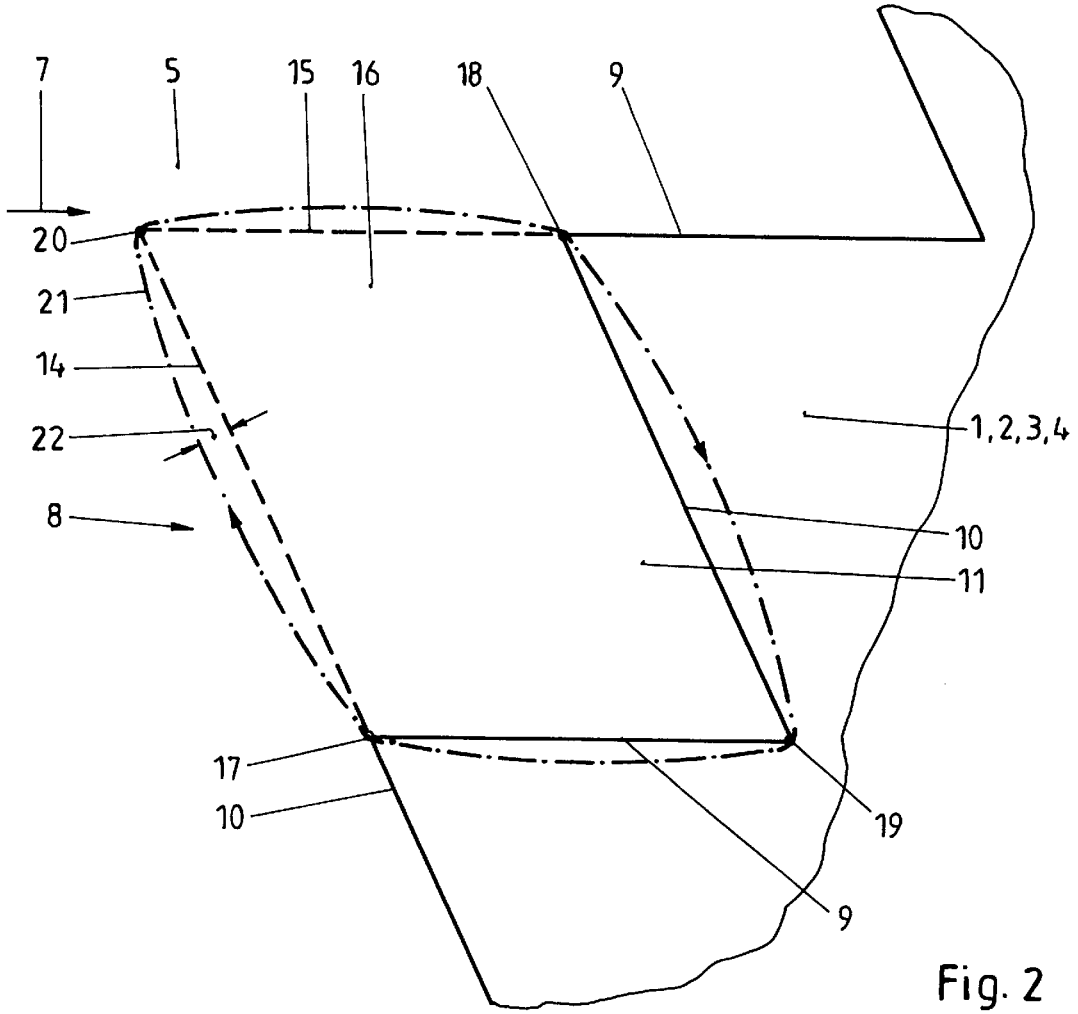
FIG. 2 is a side view of one step of the movable bar according to FIG. 1 and of the corresponding path of movement.

FIG. 2 illustrates a detailed view of one step 8 of the bar units 3 and 4 according to FIG. 1. The step 8 includes the undercut 11, and its shape is determined by the shape of the skeleton portion 9 and the rising portion 10. The broken line 14 is attained by a parallel movement or displacement of the rising portion 10. The parallel displacement of the skeleton portion 9 results in a broken line 15. The rising portion 10, the skeleton portion 9 and the lines 14 and 15 form a field 16 having a parallelogram-like shape. In case the length of the skeleton portion 9 is identical with the length of the rising portion 10, the field 16 has a diamond or rhombic shape. The field 16 includes four corners including the two corners 17 and 18 of two steps 8 being arranged above one another. The third corner of the field 16 is formed by a transitional point 19 connecting the skeleton portion 9 and the rising portion 10. The point of intersection of the lines 14 and 15 forms the fourth corner 20.

A closed path of movement 21 is illustrated by a dash-dot line. The path of movement 21 illustrates the course of the corner 17 of the step 8 when the movable bar unit 4 including the movable bars 2 is driven with respect to the stationary bar unit 3 including the stationary bars 1. The path of movement 21 is arranged such that it does not enter the field 16 at any time. The path of movement 21 is located at a distance 22 with respect to the outline of the field 16. The path of movement 21 is preferably guided through the two corners 17 and 18 of adjacent steps 8. The corners 19 and 20 may be surrounded by the path of movement 21 at a distance. Nevertheless, it is also possible to arrange the path of movement 21 such that it also covers the corners 19 and 20 of the field 16, as this is illustrated in FIG. 2.

Figure 3:
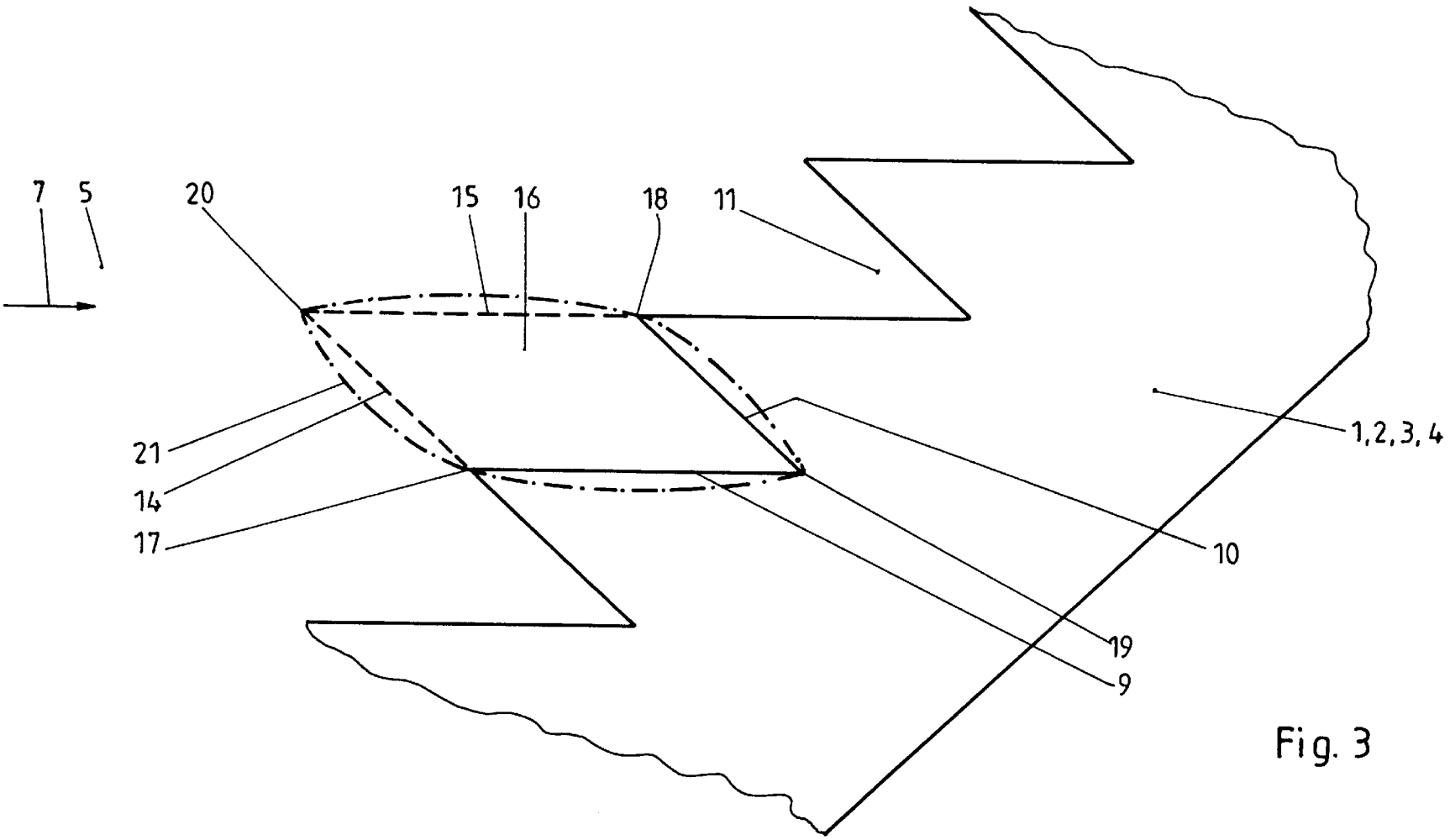
FIG. 3 is a side view of a bar having a comparatively great undercut in the skeleton portion and of the diamond-shaped field not to be entered by the path of movement.

FIG. 3 illustrates the bars 1 and 2 including steps 8 having a great undercut 11. The skeleton portion 9 is chosen to be comparatively great such that the surfaces by which the solid particles to be removed from the fluid 5 are moved in an upward direction to the next step 8 during the movement along the path of movement 21 are increased. It can be also seen from FIG. 3 that the field 16 is comparatively narrow and long having a parallelogram-like shape.

Figure 4:
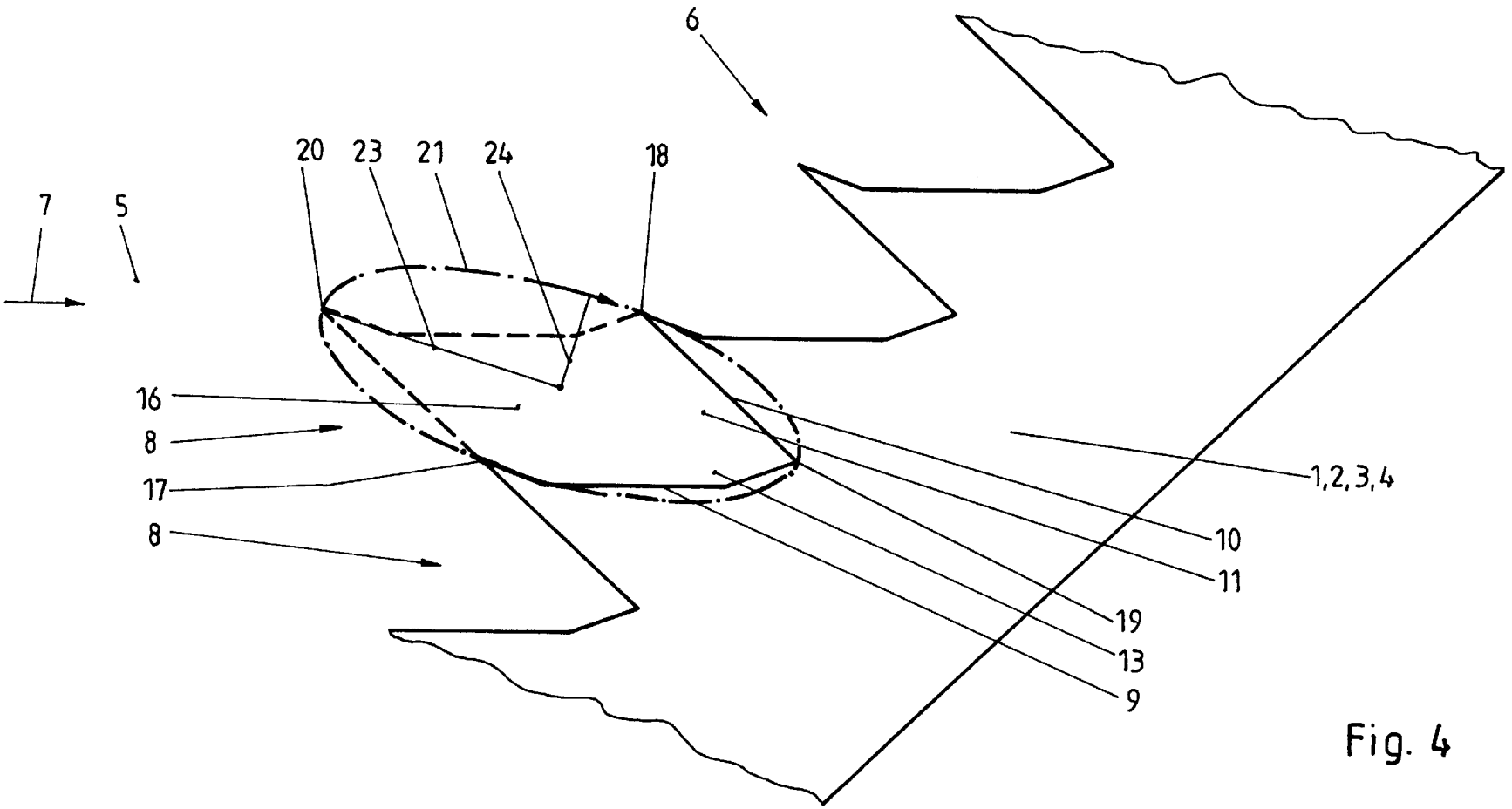
FIG. 4 is a similar view as FIG. 3 but illustrating an elliptical path of movement for a path of movement being similar to the shape of an ellipse corresponding to the shape of the bars.

While FIGS. 1 to 3 substantially explain the theoretical basis of the present invention, FIG. 4 illustrates an exemplary practical design. The grid unit 6 includes the steps 8 being located at the bars 1 and 2. The steps 8 include the undercut 11 in the region of the skeleton portion 9 and the undercut 14 in the region of the rising portion 10. The path or the track of movement 21 has the shape of an ellipse or a similar shape. This means that the path of movement 21 really has the shape of an ellipse, or the shape of the path of movement 21 looks similar to the shape of an ellipse. The ellipse according to the path of movement 21 includes a bigger semiaxis 23 and a smaller semiaxis 24. The semiaxes 23 and 24 are arranged in a way that the field 16 is not entered during the movement of the second bar unit 4 along the path of movement 21. The path of movement 21 is guided to contact all four corners 17, 18, 19 and 20. The path of movement 21 with its bigger semiaxis 23 is arranged to be inclined against the flowing direction 7 of the fluid 5.

Figure 5:
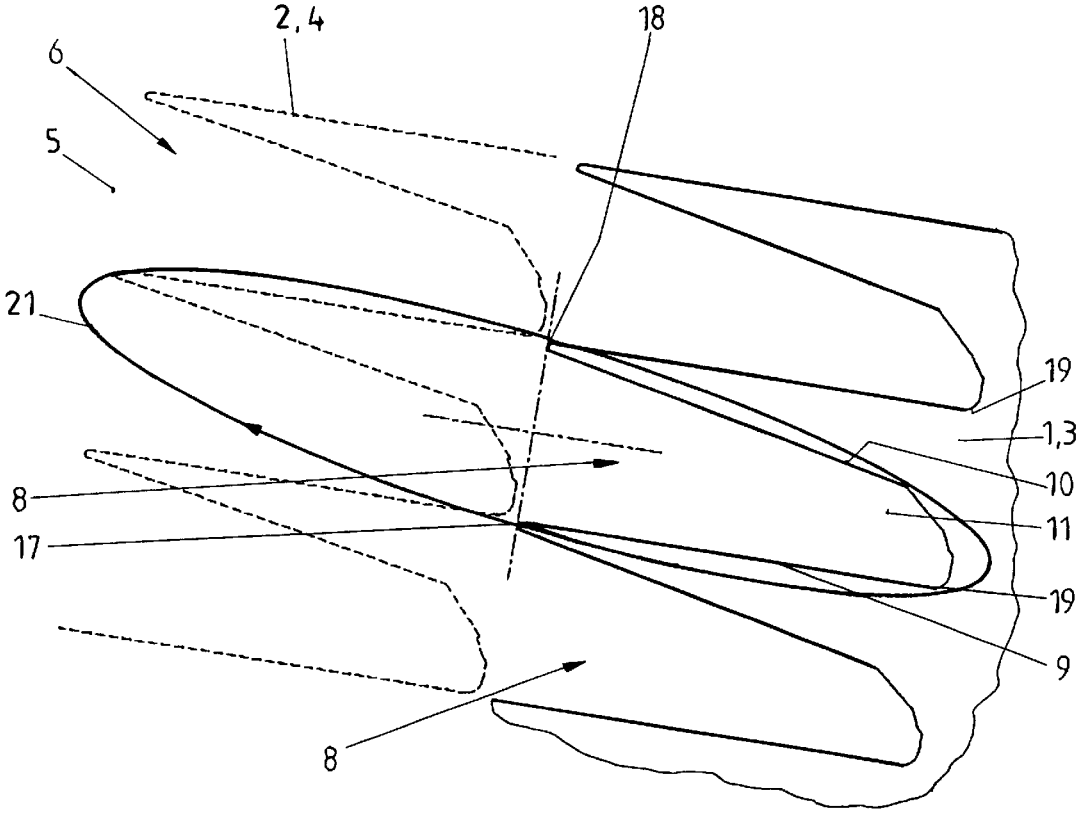
FIG. 5 is a side view of a bar having an extremely inclined arrangement and a great undercut in the region of the skeleton portion.

FIG. 5 illustrates an exemplary embodiment of the grid unit 6 in which the stationary first bars 1 and the stationary first bar unit 3 are illustrated by continuous lines. The movable second bars 2 and the movable second bar unit 4 are illustrated by broken lines. The path of movement 21 again has the shape of an ellipse or a similar shape. The steps 8 include substantial undercuts 11 in the region of the rising portion 10, while the skeleton portion 9 does not include any undercuts. The steps 8 have a sharp or peaked design. The grid unit 6 is arranged in the fluid 5 in a steep manner. Thus, the grid unit 6 has a reduced length in the flowing direction 7.

Figure 6:
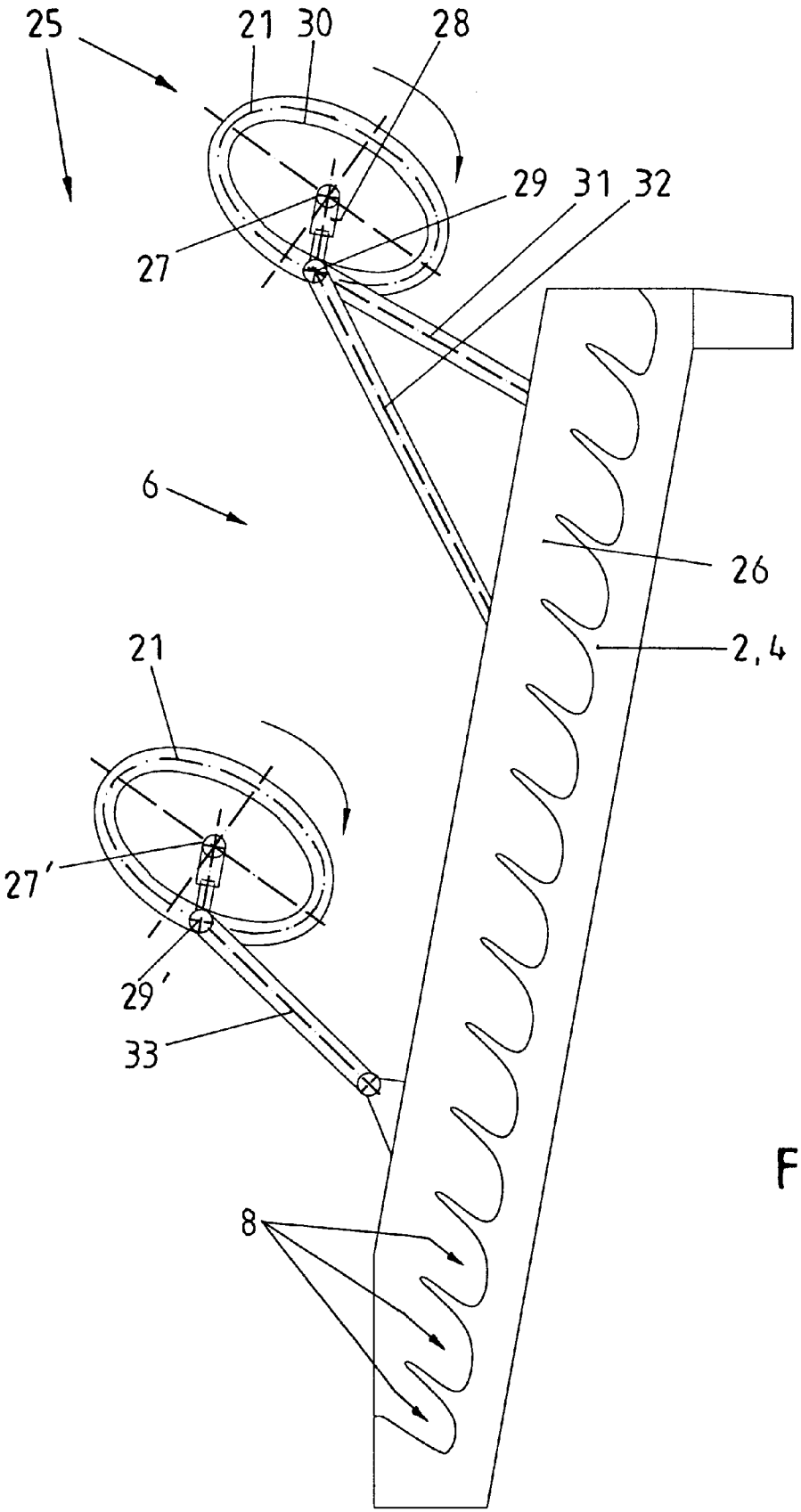
FIG. 6 is a schematic side view of the drive of the movable bar unit including a curved path.
Figure 7:
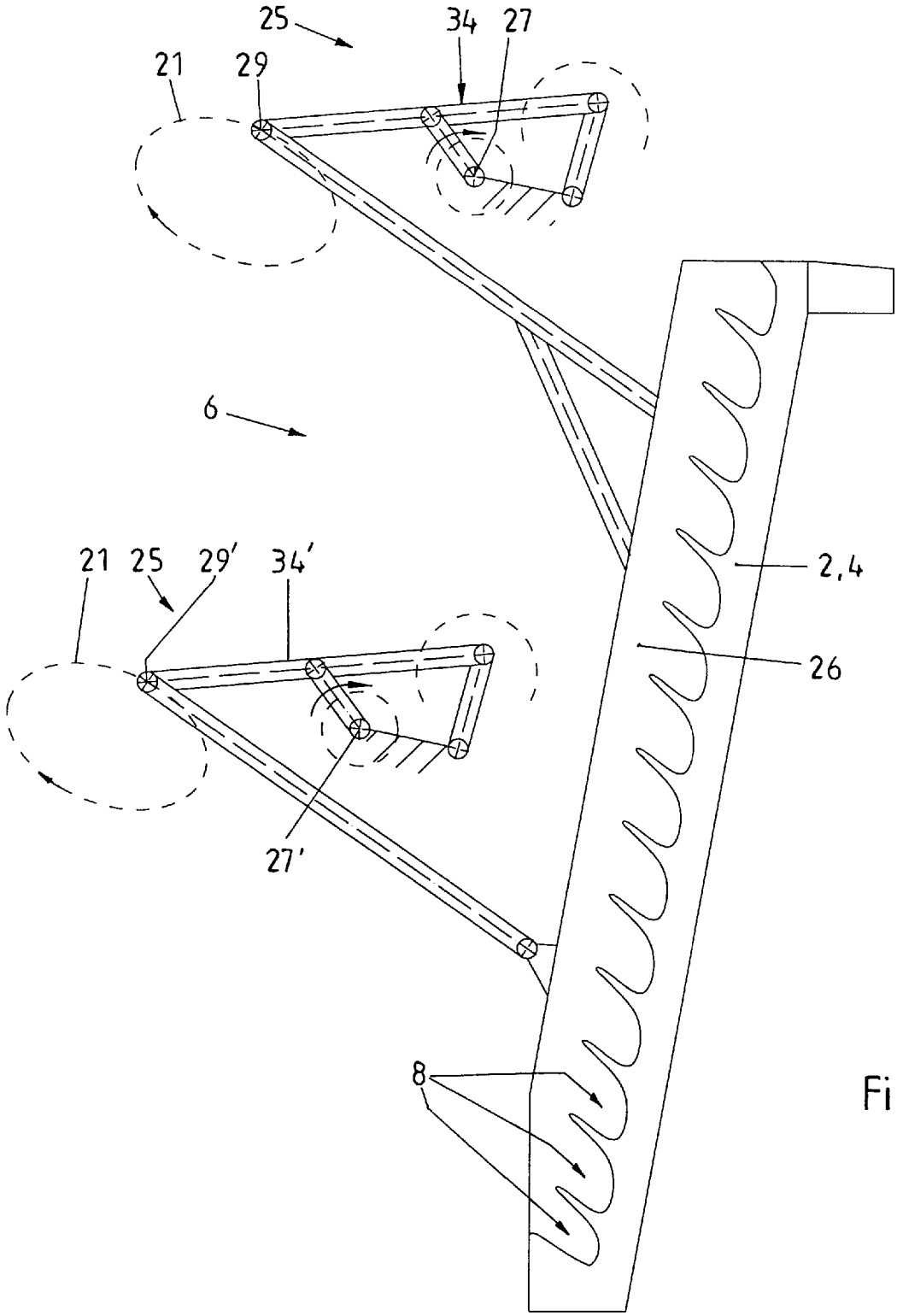
FIG. 7 is a schematic side view of the drive of the movable bar unit including a connecting rod drive.
Figure 8:
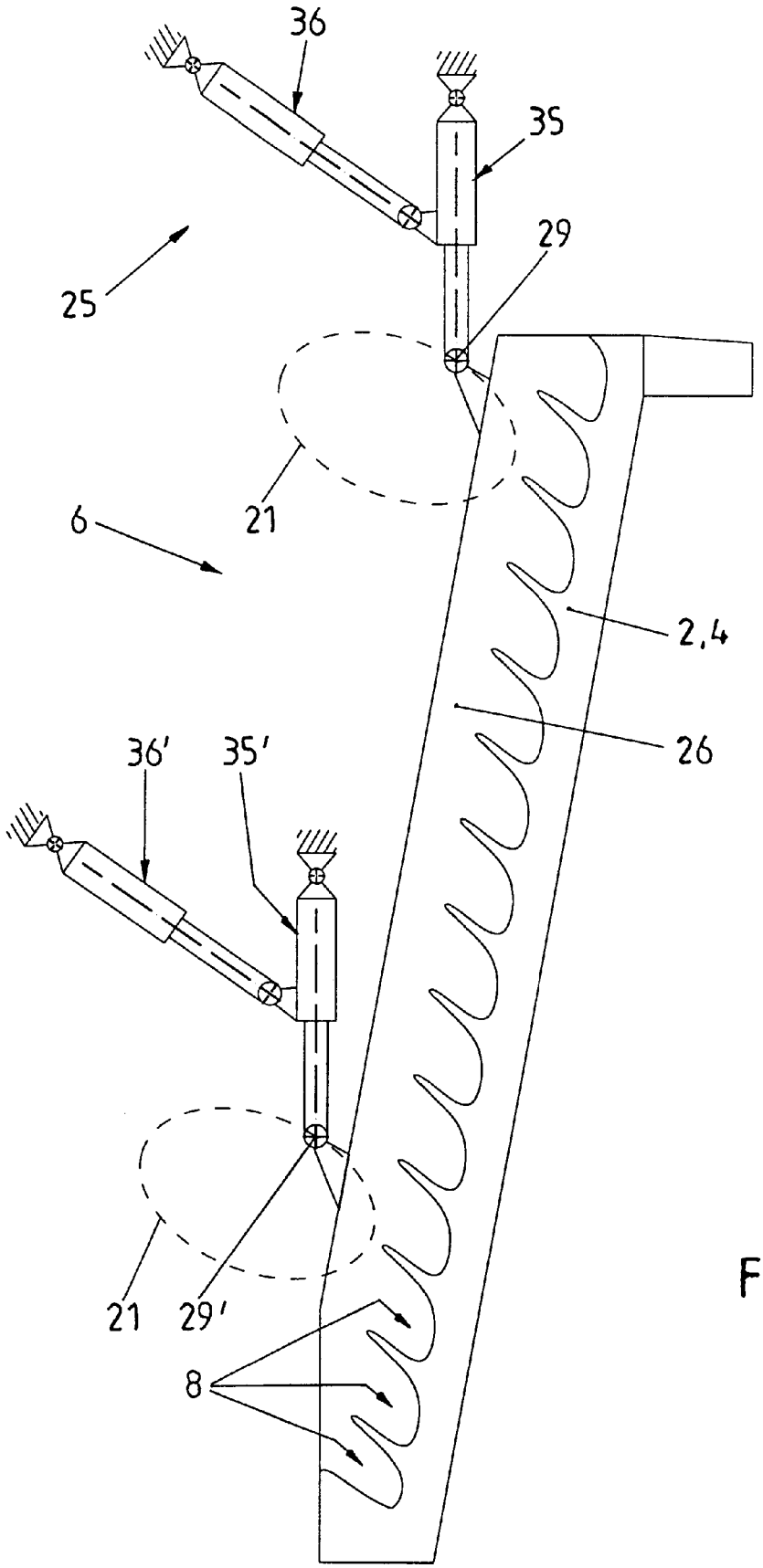
FIG. 8 is a schematic side view of the drive of the movable bar unit including two cylinders.

FIGS. 6 to 8 illustrate different drives 25 as they may be used to produce the path of movement 21. The movable bar units 4 are moved along the paths of movement 21 by the drives 25. The bar units 3 including the stationary bars 1 are not illustrated for reasons of clarity of the drawings. It is understood that the bars 1 and the bars 2 have the same design, as it is illustrated by the steps 8. The grid unit 6 may include side walls 26 forming a unit with the movable bars 2. The two outermost movable bars 2 may be used to drive the movable bar unit 4 by the drive 25. Each drive 25 may have an upper portion and a lower portion having the same or a different design, as illustrated, to drive the movable bar unit 4 parallel to itself in the plane of illustration according to the path of movement 21.

The drive 25 according to FIG. 6 includes two partial drives both being connected to the second movable bar unit 4 including the movable bars 2. The upper drive portion includes a shaft 27 being driven by a motor or an engine (not illustrated). The lower drive portion also includes such a shaft 27'. A guide rod 28 being variable in length is located on the shaft 27, and it ends in a joint 29. A curved path 30 extends congruent to the desired path of movement 21. The center of the joint 29 is moved along the curved path 30. Two arms 31 and 32 are connected to the joint 29. At their other end, the arms 31 and 32 are fixedly connected to the side wall 26. The lower portion of the drive 25 is designed correspondingly. Instead of the two arms 31 and 32, it includes a joint arm 33 connecting the joint 29' to the side wall 26. It is understood that the drive 25 is designed and arranged to have an effect on both side walls 26 of the bar unit 4.

The drive 25 as illustrated in FIG. 7 also includes an upper portion and a lower portion. The shafts 27 and 27' are also driven by a motor or an engine (not illustrated). The connecting rods 34 provide an elliptical path of movement 21 of the joints 29 and 29' which are transferred to the side wall 26.

The drive 25 as illustrated in FIG. 8 includes two cylinders 35 and 36 being arranged in its upper portion. The lower portion of the drive 25 includes two cylinders 35' and 36'. At one of their ends, the cylinders are suspended in stationary pivotal joints, while, at their other ends, they are pivotally connected to each other or to the side wall 26, respectively. The two cylinders 35 and 36 on the one hand, and the cylinders 35' and 36' on the other hand, are uniformly actuated. The cylinders 35, 36, 35' and 36' may be hydraulically or pneumatically actuated. The joints 29 and 29' move along the paths of movement 21.

Many variations and modifications may be made to the preferred embodiments of the invention without departing substantially from the spirit and principles of the invention. All such modifications and variations are intended to be included herein within the scope of the present invention, as defined by the following claims.

I claim:

1. An apparatus for collecting and removing solid particles from a flowing fluid, comprising:

a grid unit including:

a plurality of stationary first bars being arranged to form a first bar unit, each of said stationary first bars including a plurality of steps facing the flowing direction of the fluid and including a skeleton portion and a rising portion; and a plurality of movable second bars being arranged to form a movable second bar unit, each of said movable second bars including a plurality of steps facing the flowing direction of the fluid and including a skeleton portion and a rising portion, said stationary first bars and said movable second bars being arranged side by side to alternate and said steps including an undercut; and a drive for moving said movable second bar unit along a closed path of movement being substantially elliptical and including a forward movement being directed substantially against the flowing direction of the fluid, an upward movement, a backward movement being directed substantially in the flowing direction of the fluid and a downward movement, the path of movement being coordinated with the shape of said steps of said first and second bars such that said skeleton portion of said movable second bars is covered by said skeleton portion of said stationary first bars during the forward movement, said skeleton portion of said movable second bars is not covered by said rising portion of said stationary first bars during the upward movement, said skeleton portion of said movable second bars is not covered by said skeleton portion of said stationary first bars during the backward movement, and said skeleton portion of said movable second bars is covered by said rising portion of said stationary first bars during the downward movement.

2. The apparatus of claim 1, wherein said steps of said first stationary bars include a corner connecting said skeleton portion and said rising portion, and wherein said movable second bar unit is guided along the path of movement by said drive to cover said corner during the forward movement.

3. The apparatus of claim 1, wherein said steps of said first stationary bars include a corner connecting said skeleton portion and said rising portion, and wherein said movable second bar unit is guided along the path of movement by said drive to cover said corner during the backward movement.

4. The apparatus of claim 1, wherein said steps of said first stationary bars include two corners connecting said skeleton portion and said rising portion, and wherein said movable second bar unit is guided along the path of movement by said drive to cover one of said corners during the forward movement and the other corner during the backward movement.

5. The apparatus of claim 1, wherein said movable second bar unit is guided along the path of movement by said drive to cover all four corners of a field being formed by a parallel displacement of said skeleton portion and said rising portion.

6. The apparatus of claim 1, wherein said drive includes a curved path.

7. The apparatus of claim 1, wherein said drive includes a connecting rod drive.

8. The apparatus of claim 1, wherein said drive includes two hydraulic cylinders.

9. The apparatus of claim 8, wherein said two hydraulic cylinders are designed and arranged to be actuated at the same time to form the substantially elliptical path of movement.

10. The apparatus of claim 1, wherein said drive includes two pneumatic cylinders.

11. The apparatus of claim 10, wherein said two pneumatic cylinders are designed and arranged to be actuated at the same time to form the substantially elliptical path of movement.

12. The apparatus of claim 1, wherein said skeleton portion and the path of movement are arranged to be upwardly inclined with respect to the flowing direction of the fluid.

13. The apparatus of claim 1, wherein said movable second bar unit is guided parallel by said drive along the path of movement.

14. The apparatus of claim 1, wherein said undercut is formed by said skeleton portion.

15. The apparatus of claim 1, wherein said undercut is formed by said rising portion.

16. The apparatus of claim 1, wherein said undercut is formed by said skeleton portion and said rising portion.

17. The apparatus of claim 1, wherein the path of movement is elliptical.

18. The apparatus of claim 1, wherein the path of movement is similar to the shape of an ellipse.

19. The apparatus of claim 1, wherein the fluid is waste water.

20. A separating grid for collecting and removing solid particles from flowing waste water, comprising:

a grid unit to extend into the flowing waste water including:

a plurality of stationary first bars being arranged to form a first bar unit, each of said stationary first bars including a plurality of steps facing the flowing direction of the fluid and including a skeleton portion and a rising portion; and a plurality of movable second bars being arranged to form a movable second bar unit, each of said movable second bars including a plurality of steps facing the flowing direction of the fluid and including a skeleton portion and a rising portion, said stationary first bars and said movable second bars being arranged side by side to alternate and said steps including an undercut; and a drive for moving said movable second bar unit along a closed path of movement being substantially elliptical and including a forward movement being directed substantially against the flowing direction of the fluid, an upward movement, a backward movement being directed substantially in the flowing direction of the fluid and a downward movement, the path of movement being coordinated with the shape of said steps of said first and second bars such that said skeleton portion of said movable second bars is covered by said skeleton portion of said stationary first bars during the forward movement, said skeleton portion of said movable second bars is not covered by said rising portion of said stationary first bars during the upward movement, said skeleton portion of said movable second bars is not covered by said skeleton portion of said stationary first bars during the backward movement, and said skeleton portion of said movable second bars is covered by said rising portion of said stationary first bars during the downward movement.

21. An apparatus for collecting and removing solid particles from a flowing fluid, comprising:

a grid unit that includes a stationary bar having a plurality of steps and a movable bar having a plurality of steps, each of said steps having a skeleton portion and a rising portion; and a drive that displaces said movable bar relative to said stationary bar, said movable bar tracing a substantially elliptical path that comprises forward, upward, backward, and downward components, wherein said elliptical path extends substantially forwardly and upwardly away from said stationary bar such that a first semiaxis of the elliptical path that extends forwardly and upwardly relative to said stationary bar is substantially larger than a second semiaxis of the elliptical path that extends backwardly and upwardly relative to said stationary bar.

22. The apparatus of claim 21, wherein the skeleton portion of the steps includes an undercut.

23. The apparatus of claim 21, wherein the rising portion of the steps includes an undercut.

* * * * *